US005810207A

United States Patent [19]

Hayashida

[11] Patent Number: 5,810,207

[45] Date of Patent: Sep. 22, 1998

[54] CONTAINER AND HEAT-RESISTANT CAP FOR USE WITH SAME

[75] Inventor: Mitsuharu Hayashida, Nara-ken, Japan

[73] Assignee: Mikasa Industry Co., Ltd., Nara-ken, Japan

[21] Appl. No.: 797,757

[22] Filed: Feb. 7, 1997

[51] Int. Cl.[6] ..... B67D 5/38

[52] U.S. Cl. ..... 222/153.07; 222/562

[58] Field of Search ..... 222/153.07, 545, 222/562

[56] References Cited

U.S. PATENT DOCUMENTS 5,439,124 8/1995 Mock ..... 222/562 X

FOREIGN PATENT DOCUMENTS

F49122 3/1990 Japan .

*Primary Examiner*—Gregory L. Huson

*Attorney, Agent, or Firm*—Price, Heneveld, Cooper, Dewitt & Litton

[57] ABSTRACT

A heat-resistant cap for a container wherein the container includes a mouth having an external circumferential recess and a boss; an intermediate stopper having a latching portion engaged in pressure fit relation over the mouth such that a ridge provided on an inner circumferential surface of an intermediate tube is held in pressure fit relation with the external circumferential recess. An embrittled line is formed to extend circumferentially in the inner circumferential surface of the intermediate tube contiguous to an upper or lower edge of the recess. An outer lid is fitted over the intermediate stopper. An engagement portion provided on the outer lid is engaged in vertical relation with a latching portion of the intermediate stopper having a portion held in pressure fit relation with an outer circumferential surface of the intermediate tube.

10 Claims, 6 Drawing Sheets

CONTAINER AND HEAT-RESISTANT CAP FOR USE WITH SAME

BACKGROUND OF THE INVENTION

1. Title of the Invention

The present invention relates to a container for drinks or soup or the like that are heated when the container is filled, and a heat-resistant cap for use with the container.

2. Description of the Related Art

Heretofore, containers and heat-resistant caps for use with the containers, which are adapted for the purpose mentioned above, have been generally constructed as separate components configured to mate in snap fit relationship to seal the contents of the container therein. Generally, there is an inner stopper received over the mouth of the container and retained thereon by an annular ridge received within a complimentary annular recess. The upper wall of the inner stopper has a removable central portion which when torn open permits the contents of the container to be poured. Received over the inner stopper is an outer lid made of highly heat-resistant synthetic resin, e.g., polypropylene, which substantially surrounds the inner stopper and is held in pressure contact about the inner stopper. The heat resistive cap includes a lid portion attached by a living hinge so the lid may be pivotally opened and closed over the inner stopper The container and the conventional heat-resistant cap for use with the container, constructed as described above, have a problem as follows.

When the liquid commodity in the container is emptied and the container is recovered for recycling the container and the heat-resistant cap must be separated from each other. Stated otherwise, the heat-resistant cap must be removed from the container mouth. However, the heat-resistant cap cannot be easily removed from the container mouth because the ridge of the intermediate stopper is tightly engaged in vertical relation with the recess of the mouth. Also, even in an attempt to remove the heat-resistant cap by using an uncapping tool such as a cap opener, the use of an uncapping tool such as a cap opener will be in vain because an access to a lower end of the lower support portion is often blocked by a boss of the container mouth.

The present invention has been made with a view of solving the problem stated above, and its object is to provide a container and a heat-resistant cap for use with the container, which heat-resistant cap is of hit-capping type that can be easily fitted to the container by simple hitting when capped over a mouth of the container, and can also be very easily removed from the container mouth, and which container is suitable for recycling of resources.

SUMMARY OF THE INVENTION

A container and a heat-resistant cap for use with the container, embodying to the present invention, comprises a recess and a boss formed in and on an outer circumferential surface of a mouth of the container to extend circumferentially with a vertical spacing there-between; an intermediate stopper made of synthetic resin and fitted over the mouth; a gripping portion provided in the intermediate stopper and comprising an inner tube, an intermediate tube and an upper wall which are held in pressure contact with inner, outer and top surfaces of the mouth, respectively; a pouring tube extending upward from the upper wall and a latching portion formed to extend radially outward from the pouring portion; a mouth wall provided within the pouring tube and having an endless rippable groove, the mouth wall including a ripping member located above an upper surface thereof; a ridge provided on an inner circumferential surface of the intermediate tube and held in pressure contact with the recess; an outer lid comprising an outer tube held in pressure contact with a part of an outer circumferential surface of the intermediate tube and a lid member, the outer lid being made of synthetic resin having a softening temperature higher than both the softening temperature of the synthetic resin of the intermediate stopper and the boiling point of water, and having hardness greater than the synthetic resin of the intermediate stopper; an engagement portion provided on the outer lid and engaged in vertical relation with the latching portion; a lower end of the outer tube located around the intermediate tube in a position corresponding to any one of outer and lower edges and a middle region of the ridge; a lower support portion formed in the intermediate tube for supporting the lower end of the outer tube; an embrittled line formed to extend circumferentially in the inner circumferential surface of the intermediate tube in a position contiguous to selected one of the upper and lower edges of the ridge; and an embrittled portion formed to extend from a lower end of the intermediate tube to the embrittled line.

In the container and the heat-resistant cap for use with the container, preferably, the lower end of the outer tube is located in a position corresponding to the upper edge of the ridge of the intermediate tube, and the embrittled line is formed in the inner circumferential surface of the intermediate tube in a position contiguous to the upper edge of the ridge.

In the container and the heat-resistant cap for use with the container, preferably, the lower end of the outer tube is located in a position corresponding to the upper edge of the ridge of the intermediate tube, and the embrittled line is formed in the inner circumferential surface of the intermediate tube in a position contiguous to the lower edge of the ridge.

In the container and the heat-resistant cap for use with the container, preferably, the lower end of the outer tube is located in a position corresponding to the ridge of the intermediate tube, and the embrittled line is formed in the inner circumferential surface of the intermediate tube in a position contiguous to the lower edge of the ridge.

In the container and the heat-resistant cap for use with the container, preferably, the embrittled portion is formed in the form of a slit. Also, in the container and the heat-resistant cap for use with the container, preferably, the lower end of the outer tube is located in a position corresponding to substantially the lower edge of the ridge of the intermediate tube, and a part of the intermediate tube below an upper end of the lower support portion is formed to be dislocated radially outward of the remaining part thereof.

In the container and the heat-resistant cap for use with the container, preferably, the ridge is held in pressure contact with midway the recess in the vertical direction.

In the container and the heat-resistant cap for use with the container, preferably, the ridge is located in a position above a bottom portion of the recess.

In the container and the heat-resistant cap for use with the container, preferably, the outer tube and the lid member are joined to each other through a hinge.

In the container and the heat-resistant cap for use with the container, preferably, the lower support portion includes a tab provided contiguous to or in the vicinity of the embrittled portion.

DETAILED DESCRIPTION OF THE PREFERRED EMBODIMENTS

Figure 1:
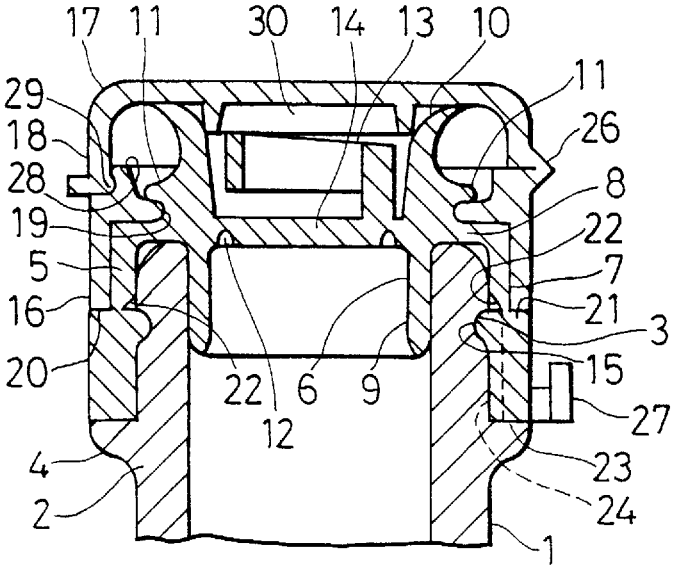
FIG. 1 is a fragmentary cross-sectional view, of a container and a heat-resistant cap for use with the container, the view showing a first embodiment of the present invention and a state where the cap is fitted to the container.
Figure 2:
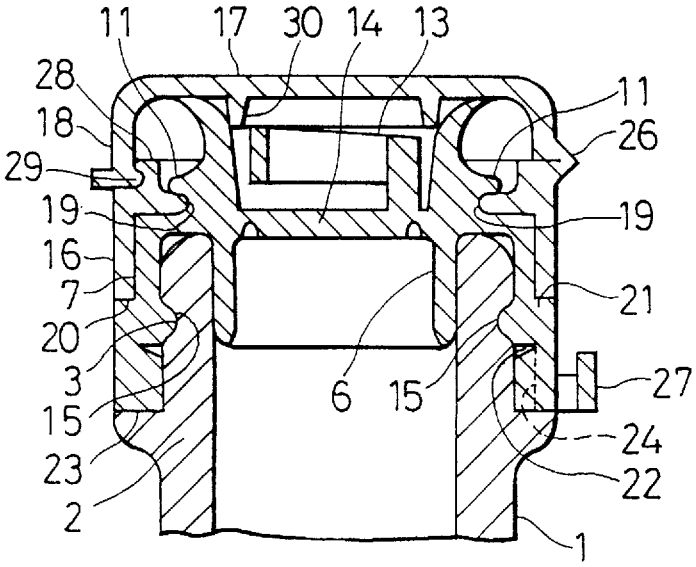
FIG. 2 is a fragmentary cross-sectional view of a second embodiment of the present invention.
Figure 3:
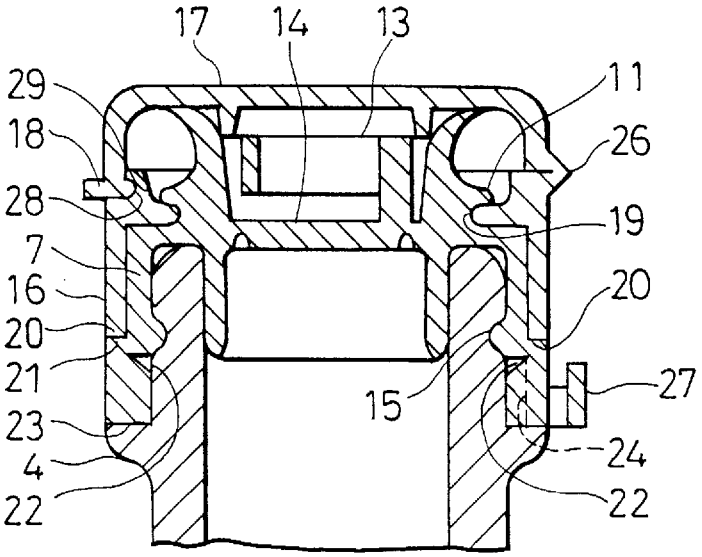
FIG. 3 is cross-sectional view of a third embodiment of the present invention.
Figure 4:
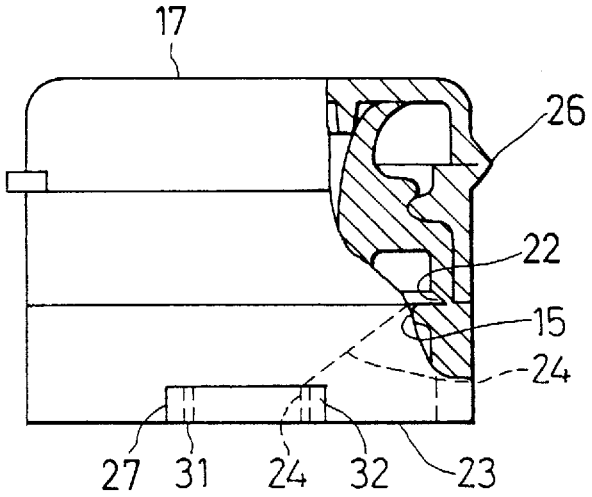
FIG. 4 is a side view, partly sectioned, of the heat resistant cap shown in FIG. 1.
Figure 5:
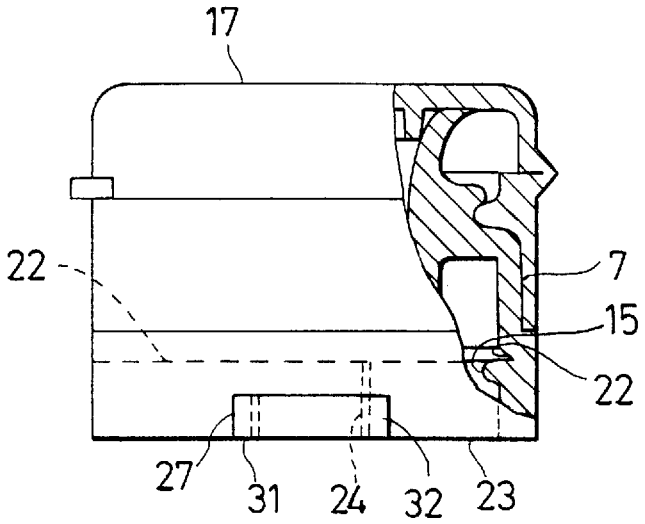
FIG. 5 is a side view, partly sectioned, of the heat-resistant cap shown in FIG. 3.

Referring to FIGS. 1 to 3, denoted by reference numeral 1 is a container illustrated as, by way of example, a glass bottle. The container 1 has a mouth 2 provided in its outer circumferential surface with an annular recess 3 and an annular boss 4 formed in the order named above with a spacing therebetween. Denoted by 5 is an intermediate stopper fitted over the mouth 2 and made of synthetic resin, e.g., polyethylene. The intermediate stopper 5 has a gripping portion 9 comprising an inner tube 6, an intermediate tube 7 and an upper wall 8. The gripping portion 9 grips the mouth 2 in such a manner that the inner tube 6, the intermediate tube 7 and the upper wall 8 are held in pressure contact with inner., outer and top surfaces of the mouth 2, respectively, thereby keeping the intermediate stopper 5 fitted over the mouth 2.

Denoted by 10 is a pouring tube extending upward from the upper wall 8, and a mouth wall 14 having an endless rippable groove 12 formed therein is provided integrally with the upper wall 8 and within the pouring tube 10. The mouth wall 14 includes a ripping member 13 in the form of a pull ring provided inside the rippable groove 12. The intermediate tube 7 has an annular ridge 15 formed on its inner circumferential surface. When the heat-resistant cap is capped over the mouth 2 of the container, the annular ridge 15 is engaged with the annular recess 3 formed in the outer circumferential surface of the mouth 2 in its upper end portion.

Denoted by 11 is a latching portion formed above the upper wall 8 to extend radially outward and engaged with an engagement portion 19 of an outer lid 18, described later, for latching the same.

Further, denoted by 18 is an outer lid made of synthetic resin, e.g., polypropylene, having a softening temperature which is greater than not only the softening temperature of the synthetic resin as material of the intermediate stopper 5, but also the boiling point of water, and having a hardness higher than the material of the intermediate stopper 5. The outer lid 18 comprises an outer tube 16 held in pressure contact with an outer circumferential surface of the intermediate tube 7 and a lid member 17. The outer tube 16 and the lid member 17 are integrally formed with each other through a hinge 26. The outer tube 16 has an annular engagement portion 19 formed on an inner circumferential surface of its upper part and, as seen from drawing FIGS. 1–3, the engagement portion 19 is engaged in vertical relation with the latching portion 11 annularly formed above the upper wall 8 of the intermediate stopper 5. The outer tube 16 has a lower end 20 located around the intermediate tube 7 in a position corresponding to any one of upper and lower edges and a middle point of the ridge 15 on the inner circumferential surface of the intermediate tube 7. More specifically, the lower end 20 of the outer tube 16 is positioned corresponding to the upper edge of the ridge 15 in the first and second embodiments shown in FIGS. 1 and 2, while it is positioned corresponding to substantially the middle point of the ridge 15 in the third embodiment shown in FIG. 3. The lower end 20 of the outer tube 16 located in any of the above positions can serve to urge the ridge 15 toward the mouth 2 for pressure contact therewith. Denoted by 28 is a locked portion and 29 is a locking portion, the former 28 being lightly locked in vertical relation by the latter 29 when the lid member 17 is closed.

Further, the intermediate tube 7 has an embrittled line 22 formed therein contiguous to any one of the upper and lower edges of the ridge 15. The embrittled line 22 is formed as a thin-walled portion, for example, and may be formed entirely or partly over the circumference of the intermediate tube 7. In the first embodiment shown in FIG. 1, the embrittled line 22 is formed contiguous to the upper edge of the ridge 15, while in the second and third embodiments shown in FIGS. 2 and 3, it is formed contiguous to the lower edge of the ridge 15. Note that the embrittled line 22 may be in the form of perforations, successive holes or notches, or combinations thereof other than the thin-walled portion. Additionally, denoted by 30 is an annular intermediate leg formed on an inner surface of the lid member 17 and coming into close contact with the pouring tube 10 when the outer lid 18 is closed.

Figure 6:
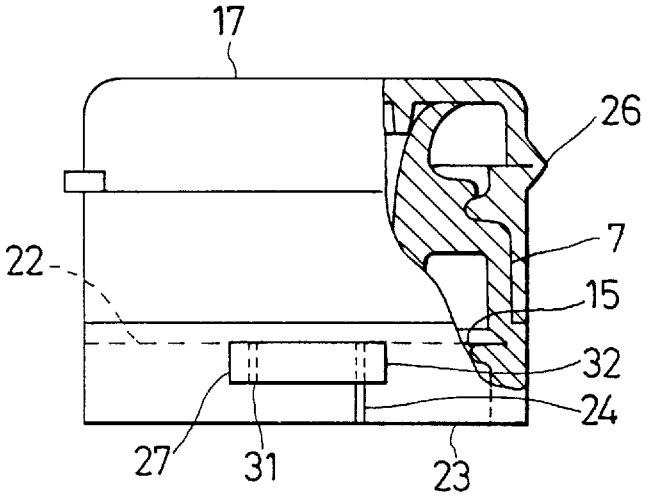
FIG. 6 is a side view, partly sectioned, of another embodiment of a heat-resistant cap.
Figure 7:
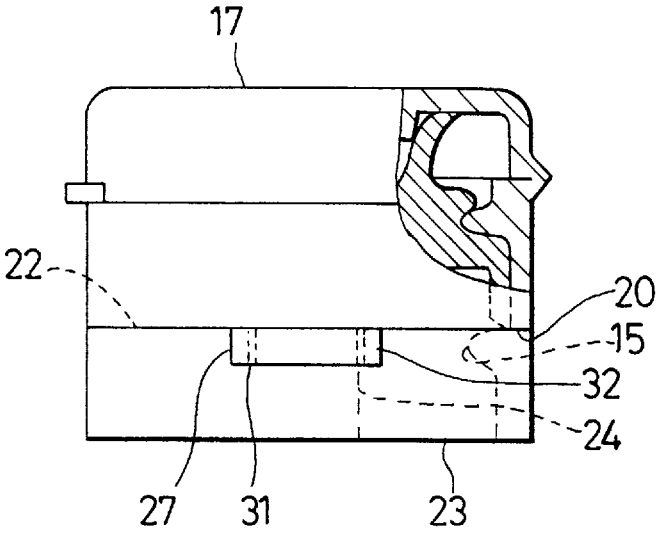
FIG. 7 is a side view, partly sectioned, of yet another embodiment of a heat-resistant cap.

Next, referring to FIGS. 4 to 7, denoted by 24 is an embrittled portion formed as a thin-walled portion, for example, to extend from a lower end 23 of the intermediate tube 7 to the embrittled line 22. The embrittled portion 24 may be in the form of perforations, successive holes or notches, or combinations thereof other than the thin-walled portion. As an alternative, the embrittled portion 24 may be in the form of a slit as shown in FIG. 6. The intermediate tube 7 also includes a tab 27 provided on its outer circumferential surface near the embrittled portion 22. When the tab 27 is pulled, a part of the intermediate tube is ripped off along the embrittled portion 24 and the embrittled line 22. Incidentally, denoted by 31 is a connecting piece formed to be easily rippable, and 32 is a secured portion of the connecting piece 31. In the heat-resistant cap of the foregoing construction, as mentioned before, when the cap is fitted to the container 1 filled with a heated liquid commodity, heat of the liquid commodity is transmitted to the intermediate tube 7 of the intermediate stopper 5 through the mouth 2, whereupon the intermediate tube 7 held in pressure contact with the mouth 2 under its elastic deformation is heated to tend to reduce the strength of the pressure contact. However, because the outer tube 16 of the outer lid 18, which is made of synthetic resin having a softening temperature against heat that is higher than not only the softening temperature of the material of the intermediate tube 7, but also the boiling point of water, and having a hardness higher than the material of the intermediate tube 7, is held in pressure contact with the outer circumferential surface of the intermediate tube 7, such a reduction in strength of the pressure contact of the intermediate tube 7 is compensated by the pressure contact of the outer tube 16. As a result, a reduction in degree of sealing can be kept within a practically allowable range.

Figure 10:
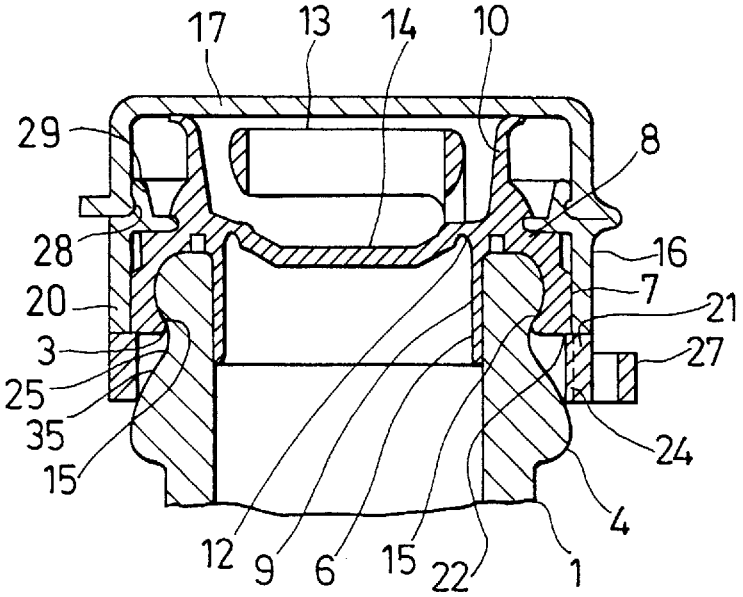
FIG. 10 is a fragmentary cross-sectional view, of a container and a heat-resistant cap for use with the container, the view showing a sixth embodiment of the present invention and a state where the cap is fitted to the container.
Figure 11:
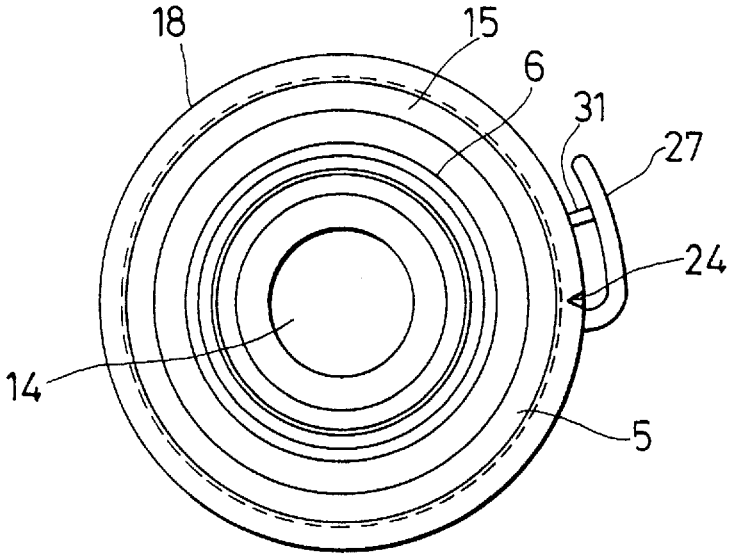
FIG. 11 is a bottom view of the heat-resistant cap shown in FIG. 10.

It is to be noted that a cap of another embodiment such as shown in FIG. 10 also operates in the same manner as described above. Denoted by 21 is a lower support portion.

Figure 8:
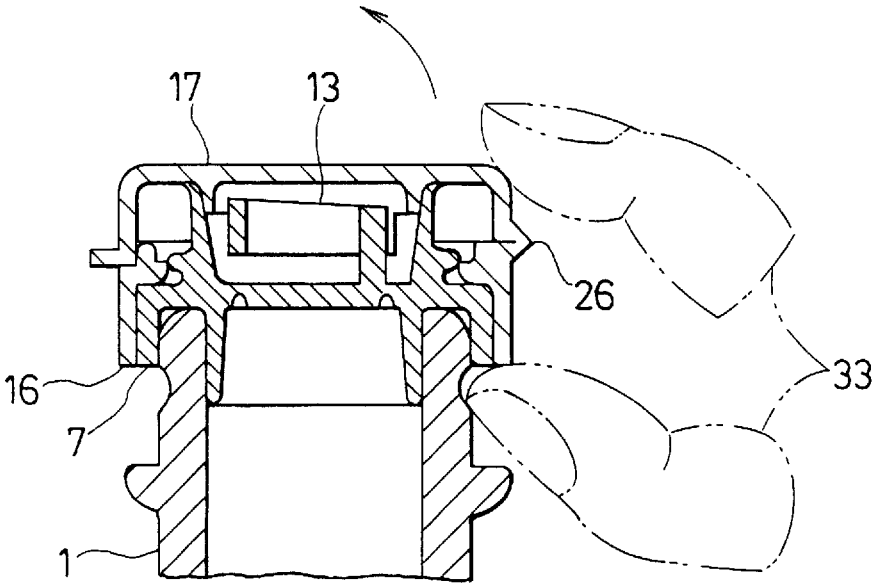
FIG. 8 is a view showing a state where the heat-resistant cap shown in FIG. 1 is being removed from the container.

When the liquid commodity in the container 1 is used up and the container 1 is recovered for recycling of resources, the embrittled portion 24 of the intermediate tube 7 and then the embrittled line 22 connecting to the former are ripped up. At this time, since the embrittled line 22 is formed contiguous to selected one of the upper and lower edges of the ridge 15, the intermediate tube 7 is ripped up circumferentially at the upper or lower edge of the ridge 15. Further, unlike the conventional cap described above, the lower end 20 of the outer tube 16 is not extended to reach the lower end 23 of the intermediate tube 7, but is terminated in a position adjacent to the ridge 15. Thus, the outer tube 16 can serve to press the ridge 15 inward on one hand, and allows the intermediate tube 16 to be ripped up along the embrittled line 22 in spite of the presence of itself on the other hand. The intermediate tube 16 may be ripped up completely when the embrittled line 22 is formed all over the circumference thereof, or partly when it is formed over a part of the circumference thereof. In the case where the embrittled line 22 is formed contiguous to the upper edge of the ridge 15, forces urging the ridge 15 into the pressure contact state are weakened by partly ripping up the intermediate tube 7 along the embrittled line, or are completely eliminated by ripping up same all over the circumference thereof. Accordingly, the heat-resistant cap can be easily removed from the mouth by placing a finger 33 against the ripped-up edge of the intermediate tube 7 and pushing it upward, as shown in FIG. 8.

Figure 9:
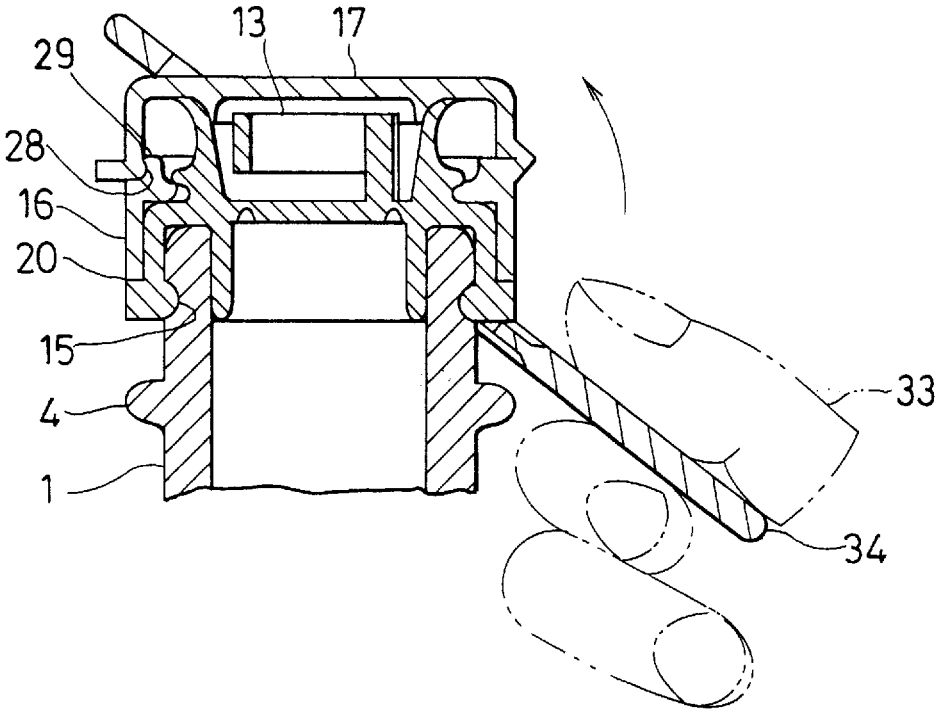
FIG. 9 is a view showing a state where a heat-resistant cap shown in FIG. 2 is being removed from a container.

In the case where the embrittled line 22 is formed contiguous to the lower edge of the ridge 15, the heat-resistant cap can be easily removed from the mouth by placing an uncapping tool 34 such as a cap opener against the ripped-up edge of the intermediate tube 7 and pushing it upward, as shown in FIG. 9.

Furthermore, in the cap wherein the embrittled line 22 and the lower end 20 of the outer tube 16 are substantially aligned with each other in the radial direction, ripping forces are just directly transmitted to the embrittled line 22, enabling starting of the ripping up in a snap, because the intermediate tube 7 is less deformed due to the rigidity of the outer tube 16 having hardness higher than the intermediate tube 7.

In the cap wherein the lower end 20 of the outer tube 16 is positioned corresponding to the upper edge of the ridge 15 and the embrittled line 22 is formed along the lower edge of the ridge 15, ripping forces are also directly transmitted to the embrittled line 22, enabling starting of the ripping up in a snap, because the lower end 20 of the outer tube 16 is present near the embrittled line 22 and the intermediate tube 7 is less deformed for essentially the intermediate tube 7 is less deformed for essentially the same reason as in the above cap.

In the cap wherein the lower end 20 of the outer tube 16 is positioned corresponding to substantially the middle point of the ridge 15 and the embrittled line 22 is formed contiguous to the lower edge of the ridge 15, as shown in FIG. 3, it is also possible to start the ripping up in a snap for essentially the same reason as in the above cap.

The ripping-up can be more easily started by the presence of the tab 27 provided contiguous to or in the vicinity of the embrittled portion 24 as shown in FIGS. 4 to 7. In other words, by gripping the tab 27 and pulling it outward, ripping forces can be easily applied to the embrittled portion 24.

In addition, when removing the heat-resistant cap from the container, the cap can be removed by placing the finger 33 or the uncapping tool such as a cap opener in contact with the outer lid 18 having higher hardness, i.e., rigidity, than the intermediate stopper 5, because the latching portion 11 of the intermediate stopper 5 is so tightly engaged with the engagement portion 19 of the outer tube 16 in its upper portion that the intermediate stopper 5 and the outer tube 16 are integrally fitted to each other over a wide circumferential region. Therefore, in comparison with the case of applying forces to a part of the relatively soft intermediate stopper 5 through direct dispersion of the forces due to a partial elastic deformation of the intermediate stopper 5 is less, thus enabling comfortable and easy removal of the cap.

Next, a container and a heat-resistant cap for use with the container, shown in FIG. 10, according to a sixth embodiment of the present invention will be described below. Referring to FIG. 10, a part of the intermediate tube 7 below an upper end of its lower support portion 21 is formed to be dislocated radially outward of the remaining part thereof, and the lower end 20 of the outer tube 16 is positioned substantially at the same level as the ridge 15. The outer circumferential surface of the mouth 2 includes a slope 35 extended from the recess 3 to the boss 4. The ridge 15 of the intermediate tube 7 is located midway the recess 3 in the vertical direction and is held in pressure contact with the recess 3 in a position above a bottom portion 25 of the recess 3.

Figure 12:
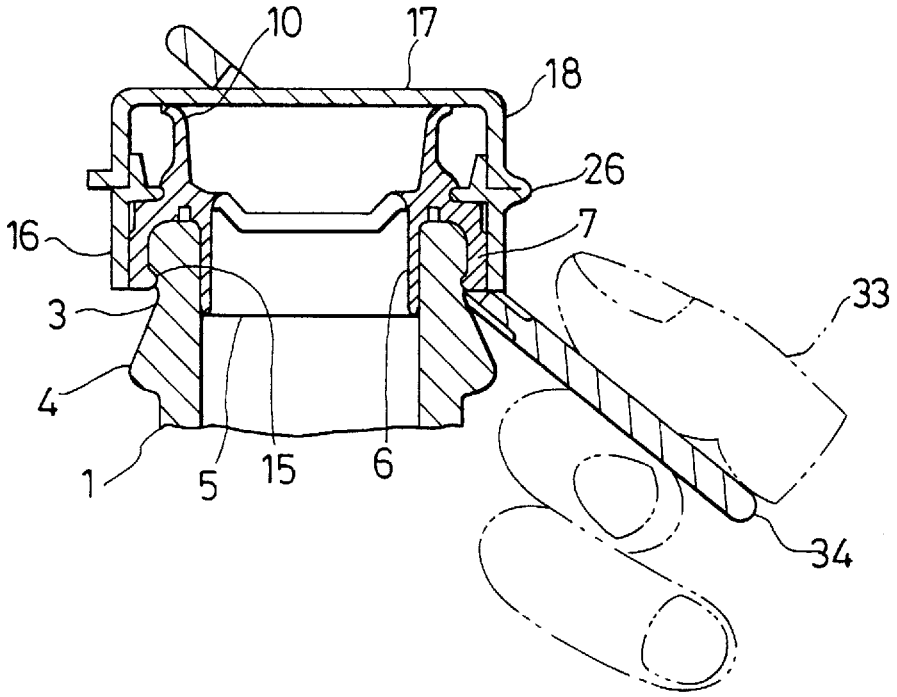
FIG. 12 is a fragmentary cross-sectional view showing a state where the heat-resistant cap shown in FIG. 10 is being removed from the container.

The container and the heat-resistant cap for use with the container, which are constructed as described above, operate essentially in the same manner as with the other embodiments shown in FIGS. 1 to 9. A liquid commodity filled in the container 1 can be used by opening the lid member 17, pulling the ripping member 13 and ripping off the mouth wall 14 along the rippable groove 12. When the liquid commodity in the container 1 is used up and the container 1 is recovered for recycling of resources, the tab 27 is pulled so as to rip up the intermediate tube 7 along the embrittled portion 24 and then the embrittled line 22. The ripping-up causes the lower ends of the intermediate tube 7 and the outer tube 16 to appear substantially at the same level, as shown in FIG. 12. Therefore, the heat-resistant cap can be easily removed from the container 1 by placing the uncapping tool 34 such as a cap opener against the lower ends of the intermediate tube 7 and the outer tube 16. Note that, instead of using the uncapping tool 34 such as a cap opener, the cap can also be easily removed from the container 1 by applying forces directly with the finger 33.

In the heat-resistant cap of this embodiment, since the part of the intermediate tube 7 below the upper end of the lower support portion 21 is formed to be dislocated radially outward of the remaining part thereof, ripping forces are concentrated on the outwardly dislocated portion when applied to rip up the intermediate tube 7 along the embrittled line 22, so that the intermediate tube 7 can be easily ripped up along the embrittled line 22. Also, since the ridge 15 of the intermediate tube 7 is located midway the recess 3 in the vertical direction, the heat-resistant cap can be more easily removed from the container 1 when uncapped.

Advantages of the present invention are as follows.

According to the present invention constructed as described above, when the heat-resistant cap is fitted to the mouth 2 of the container 1 filled with a heated liquid commodity, a reduction in degree of sealing due to heat of the liquid commodity transmitted through the mouth 2 can be kept within a practically allowable range. Also, when the container 1 is recovered for recycling of resources, the heat-resistant cap can be very easily removed from the mouth 2 of the container 1 by such a simple operation as ripping up the intermediate tube 7 along the embrittled portion 24 and then the embrittled line 22 connecting to the former.

According to the feature defined in claim 2, the heat-resistant cap can be very easily removed by the finger 33 without using the uncapping tool 34 such as a cap opener.

According to the feature defined in claim 3, the heat-resistant cap can be very easily removed by using the uncapping tool 34 such as a cap opener.

According to the feature defined in claim 4, the outer tube 16 can satisfactorily bring the ridge 15 of the intermediate tube 7 into pressure contact with the mouth 2, and the heat-resistant cap can be very easily removed by using the uncapping tool 34 such as a cap opener.

According to the feature defined in claim 5, since the embrittled portion 24 is in the form of a slit, it is very easy to start ripping up the intermediate tube 7 along the embrittled line 22.

According to the feature defined in claim 6, since the part of the intermediate tube 7 below the upper end of the lower support portion 21 is formed to be dislocated radially outward of the remaining part thereof, ripping forces tend to concentrate on the outwardly dislocated portion so that the intermediate tube 7 can be more easily ripped up along the embrittled line 22.

According to the feature defined in claim 7, since the ridge 15 is held in pressure contact with midway the recess 3 in the vertical direction, the heat-resistant cap can be easily removed from the mouth 2.

According to the feature defined in claim 8, since the ridge 15 is located in a position above the bottom portion 25 of the recess 3, the heat-resistant cap can be more easily removed from the mouth 2.

According to the feature defined in claim 9, since the outer tube 16 and the lid member 17 are joined to each other through the hinge 26, the rigidity of the outer lid 18 can be maintained by such a structure when a heated liquid commodity is filled in the container and the cap is fitted to the container. As a result, a reduction in degree of sealing of the intermediate stopper 5 is compensated by the pressure contact of the outer lid 18 with the intermediate stopper 5.

According to the feature defined in claim 10, since the tab 27 is provided contiguous to or in the vicinity of the embrittled portion 24, the part of the intermediate tube 7 below the upper end of the lower support portion 21 can be easily ripped away along the embrittled line 22 by gripping the tab 27, although the intermediate tube 7 has a less grippable portion and is more hard to grip by the presence of the outer tube 16 held in pressure contact with the intermediate tube 7.

What is claimed is:

1. A container and a heat-resistant cap for use with said container, comprising a recess and a boss formed in and on an outer circumferential surface of a mouth of a container to extend circumferentially with a vertical spacing therebetween; an intermediate stopper made of synthetic resin and fitted over said mouth; a gripping portion provided in said intermediate stopper and comprising an inner tube, an intermediate tube and an upper wall which are held in pressure contact with inner, outer and top surfaces of said mouth, respectively; a pouring tube extending upward from said upper wall and a latching portion formed to extend radially outward from said pouring portion; a mouth wall provided within said pouring tube and having an endless rippable groove, said mouth wall including a ripping member located above an upper surface thereof; a ridge provided on an inner circumferential surface of said intermediate tube and held in pressure contact with said recess; an outer lid comprising an outer tube held in pressure contact with a part of an outer circumferential surface of said intermediate tube and a lid member, said outer lid being made of synthetic resin having a softening temperature higher than both the softening temperature of the synthetic resin of said intermediate stopper; an engagement portion provided on said outer lid and engaged in vertical relation with said latching portion; a lower end of said outer tube located around said intermediate tube in a position corresponding to any one of outer and lower edges and a middle region of said ridge; a lower support portion formed in said intermediate tube for supporting the lower end of said outer tube; an embrittled line formed to extend circumferentially in the inner circumferential surface of said intermediate tube in a position contiguous to selected one of the upper and lower edges of said ridge; and an embrittled portion formed to extend from a lower end of said intermediate tube to said embrittled line.

2. A container and a heat-resistant cap for use with said container according to claim 1, wherein the lower end of said outer tube is located in a position corresponding to the upper edge of said ridge of said intermediate tube, and said embrittled line is formed in the inner circumferential surface of said intermediate tube in a position contiguous to the upper edge of said ridge.

3. A container and a heat-resistant cap for use with said container according to claim 1, wherein the lower end of said outer tube is located in a position corresponding to the upper edge of said ridge of said intermediate tube, and said embrittled line is formed in the inner circumferential surface of said intermediate tube in a position contiguous to the lower edge of said ridge.

4. A container and a heat-resistant cap for use with said container according to claim 1, wherein the lower end of said outer tube is located in a position corresponding to said ridge of said intermediate tube, and said embrittled line is formed in the inner circumferential surface of said intermediate tube in a position contiguous to the lower edge of said ridge.

5. A container and a heat-resistant cap for use with said container according to claim 1, wherein said embrittled portion is formed in the form of a slit.

6. A container and a heat-resistant cap for use with said container according to claim 1, wherein the lower end of said outer tube is located in a position corresponding to substantially the lower edge of said ridge of said intermediate tube, and a part of said intermediate tube below an upper end of said lower support portion is formed to be dislocated radially outward of the remaining part thereof.

7. A container and a heat-resistant cap for use with said container according to claim 6, wherein said ridge is held in pressure contact with midway said recess in the vertical direction.

8. A container and a heat-resistant cap for use with said container according to claim 7, wherein said ridge is located in a position above a bottom portion of said recess.

9. A container and a heat-resistant cap for use with said container according to claim 8, wherein said outer tube and said lid member are joined to each other through a hinge.

10. A container and a heat-resistant cap for use with said container according to claim 9, wherein said lower support portion includes a tab provided contiguous to or in the vicinity of said embrittled portion.

* * * * *

UNITED STATES PATENT AND TRADEMARK OFFICE

CERTIFICATE OF CORRECTION

PATENT NO. : 5,810,207

DATED : September 22, 1998

INVENTOR(S) : Hayashida

It is certified that error appears in the above-identified patent and that said Letters Patent is hereby corrected as shown below:

On the title page, insert item [30] Foreign Application Data
--Feb. 8, 1996 [JP] Japan.....08-022686
Jun. 12, 1996 [JP] Japan.....08-151103--

Signed and Sealed this

Twenty-third Day of February, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,810,207
DATED : September 22, 1998
INVENTOR(S) : Mitsubaru Hayashida It is certified that error appears in the above-indentified patent and that said Letters Patent is hereby corrected as shown below:

Column 1, Line 5;
Delete "1.".

Column 1, Line 10;
Delete "2.".

*Column 1, Line 28;
After "The" insert --conventional--; delete "the conventional" (2nd occurrence)

Column 1, Line 56;
After "embodying" delete "to".

Column 3, Line 9;
After "is" insert --a fragmentary--.

Column 8, Line 23;
After "intermediate stopper", insert --and the boiling point of water, and having higher hardness than the synthetic resin of said intermediate stopper--.

Signed and Sealed this

Twenty-third Day of November, 1999

*Attest:*

Q. TODD DICKINSON

*Attesting Officer*

*Acting Commissioner of Patents and Trademarks*